US005573851A

United States Patent [19]

Lengers et al.

[11] Patent Number: 5,573,851

[45] Date of Patent: Nov. 12, 1996

[54] ULTRAVIOLET-DETECTABLE MARKING YARN AND A TEXTILE FABRIC PRODUCT THEREWITH

[75] Inventors: Hans L. Lengers, Lancaster, S.C.; Gerhard Storandt, Newland, N.C.; James McCormick, Newland, N.C.; William M. Secrest, Newland, N.C.; Michael D. Horney, Newland, N.C.

[73] Assignee: U.S. Textile Corporation, Lancaster, S.C.

[21] Appl. No.: 243,456

[22] Filed: May 16, 1994

(Under 37 CFR 1.47)

[51] Int. Cl.[6] ..... D02G 3/00; D03D 3/00

[52] U.S. Cl. ..... 428/378; 428/229; 428/375; 57/232; 57/258

[58] Field of Search ..... 428/378, 375, 428/229; 57/232, 258

[56] References Cited

U.S. PATENT DOCUMENTS 3,671,524 6/1972 Suzuki ..... 428/378

4,347,284 8/1982 Tsutomu et al. ..... 428/328

4,620,650 11/1986 Gazzarrini .

5,058,516 10/1991 Maegawa et al. .

*Primary Examiner*—James Withers

*Attorney, Agent, or Firm*—Shefte, Pinckney & Sawyer

[57] ABSTRACT

A marking yarn for selective use in formation of a textile fabric, such as a tubular pantyhose blank, comprises an elongate strand-like yarn base formed of a water-soluble material and at least partially coated with a material which is detectible by an ultraviolet sensor. When the marking yarn is included in the textile fabric, e.g., by knitting one or more courses of the marking yarn in plated relation with the body yarn of the hosiery blank, the yarn effectively designates a predetermined location in the fabric of the hosiery blank which can be subsequently detected by an ultraviolet sensor in the sewing of the hosiery blank into a pantyhose garment. In subsequent wet processing of the garment, e.g., dyeing, the marking yarn dissolves, thereby removing it from the fabric and liberating the coating material.

7 Claims, 1 Drawing Sheet

ULTRAVIOLET-DETECTABLE MARKING YARN AND A TEXTILE FABRIC PRODUCT THEREWITH

BACKGROUND OF THE INVENTION

The present invention relates generally to textile yarns and the use thereof in making textile fabrics. More particularly, the present invention relates to a novel textile marking yarn which is detectible by an ultraviolet sensor and to a method of making a textile fabric product utilizing the marking yarn to designate a predetermined location in the textile fabric for subsequent detection in a fabric handling operation.

Many modern textile machines exist for automated performance of various steps in the handling and fabrication of apparel and other textile products from textile fabrics. In the operation of such machines, the proper positioning of the textile fabric can be critical to the proper operation of the machine and the quality of the end product. One means of accomplishing this objective is to provide a suitable marking on the textile fabric which can be detected by an appropriate sensor on the fabric handling machine to facilitate an automated mechanical fabric positioning step in the operation of the machine.

For example, in the conventional fabrication of women's pantyhose, tights and the like, various machines from differing manufacturers are conventionally available and in use for automatically performing the basic steps of positioning a pair of pantyhose blanks side-by-side, slitting each blank lengthwise a predetermined dimension and then sewing the thusly-slit edges of the two blanks together along a U-shaped seam line to produce a pair of pantyhose. In the automated performance of this operation, such machines typically provide a pair of side-by-side parallel forms over which corresponding ends of the two tubular pantyhose blanks are respectively telescoped. In carrying out this operation, it is critical that the respective ends of the blanks placed over the forms be precisely aligned with one another. Correct alignment can be accomplished manually but many conventional pantyhose-sewing machines utilize a photodetector to photoelectrically detect visible colored markings placed at a predetermined uniform location on each pantyhose blank, thereby enabling the machine to automatically position each pantyhose blank consistently and uniformly at the same position preparatory to the slitting and sewing operation.

As will be understood, it is undesirable for the marking to remain in the finished pantyhose product and, accordingly, various approaches have been proposed and taken to remove the marking during subsequent processing and finishing of the sewn pantyhose garment. Ideally, the marking should be capable of being formed in the pantyhose blanks automatically during the fabrication of the blanks so that it is unnecessary to perform an additional step especially to place the marking in the blanks and, likewise, the marking should be capable of being removed from the sewn pantyhose garment without performing an additional process especially for removing the marking.

SUMMARY OF THE INVENTION

It is accordingly an object of the present invention to provide an improved textile marking yarn and a method of making a textile fabric product utilizing the yarn which provides the desirable advantages described above.

Briefly summarized, the marking yarn of the present invention accomplishes this objective by utilizing an elongate strand-like yarn base formed of a water soluble material and at least partially coating the yarn base with a material which is detectible by an ultraviolet sensor. Thus, in making a textile fabric product utilizing the present marking yarn, a textile fabric is initially formed of at least one main body yarn which provides structural integrity to the fabric, with the marking yarn being selectively placed at a predetermined location in the textile fabric so as to be detectible by an ultraviolet sensor during a subsequent handling operation on the textile fabric. Since the base material from which the marking yarn is fabricated is water soluble, the marking yarn is readily and automatically dissolved from the fabric during any subsequent wet processing operation, such as fabric dyeing, thereby also liberating the coating material even if the coating material is not itself water soluble.

Thus, for example, the marking yarn of the present invention is particularly suitable for use in the knitting of a tubular pantyhose blank to designate a blank positioning location which is detectible by equipping a pantyhose sewing machine with an ultraviolet sensor. More specifically, in the preferred fabrication of tubular hosiery blanks by circular knitting, the marking yarn may preferably be knit in plated relation with the main body yarn of the tubular blank at the designated marking location. Preferably, the yarn base of the present marking yarn is formed of a single continuous filament of a polyvinyl alcohol material. As aforementioned, the ultraviolet detectible coating material need not be water soluble and, in the preferred embodiment, is an oil-based material.

DESCRIPTION OF THE PREFFERED EMBODIMENT

Figure 1:
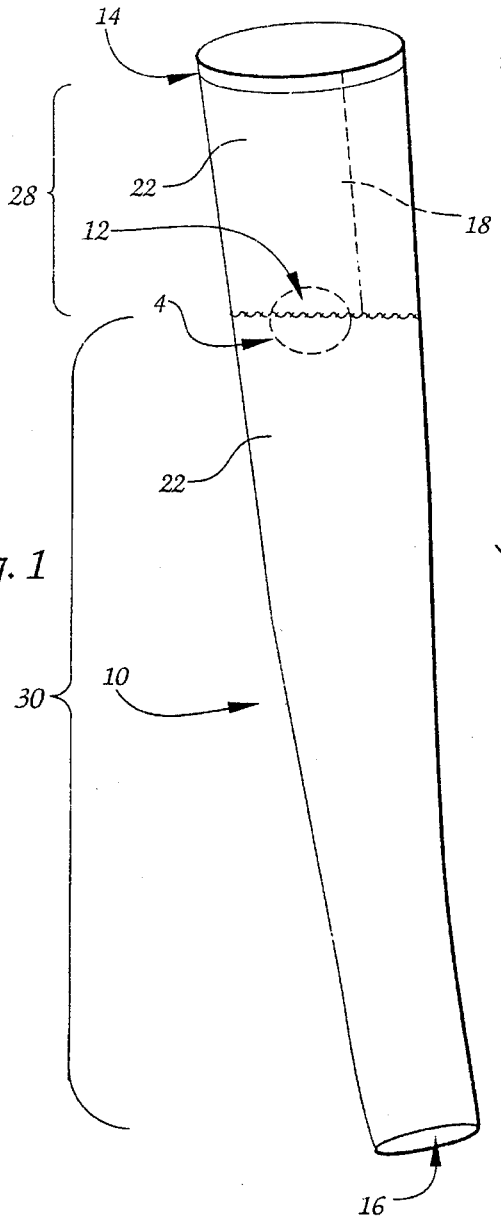
FIG. 1 is a perspective view of a tubular hosiery blank having a circumferential positioning mark formed by the ultraviolet-detectible marking yarn of the present invention.

Referring now to the accompanying drawings and initially to FIG. 1, a pantyhose blank of substantially conventional construction is indicated generally at 10, and includes a marking yarn in accordance with the present invention, indicated generally at 12, extending circumferentially about the tubular blank 10 at a predetermined location designating the appropriate position for placement of the blank on a conventional pantyhose slitting and sewing machine (not shown).

As those persons skilled in the art will readily recognize and understand, the fabrication and construction of tubular hosiery blanks of the type used in the formation of pantyhose are well-known and therefore need not be fully described herein. Basically, tubular pantyhose blanks such as the blank 10 of FIG. 1 are conventionally knitted on a small-diameter circular knitting machine utilizing one or more main body yarns which are selectively fed to the knitting needles in the cylinder of the knitting machine as the cylinder rotates progressively to stitch the body yarns into interknitted loops extending in circumferential courses and axial wales, the knitting of the blank 10 progressing in this fashion for a predetermined number of revolutions of the knitting machine sufficient to knit the blank 10 of a desired length. In this knitting operation, the end of the blank 10 initially formed on the knitting machine is typically fabricated with a dual-thickness turned welt, indicated at 14 to form a waistband in the finished pantyhose garment. At the completion of the knitting operation, the opposite end of the blank 10 is cast off the needles of the knitting machine, forming an unfinished edge, indicated at 16, which is subsequently seamed together in a sewing operation to form a closed toe portion of the pantyhose blank.

Figure 2:
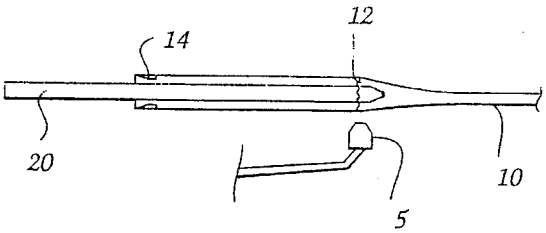
FIG. 2 is a schematic depiction of the tubular pantyhose blank of FIG. 1 as placed on a form of a representative pantyhose slitting and sewing machine, depicting the detection of the marking yarn by an ultraviolet sensor.

As previously described, a pair of pantyhose is conventionally fabricated from a pair of the pantyhose blanks 10 of FIG. 1 by positioning the waistband ends 14 of the two blanks in side-by-side relation, slitting each blank 10 longitudinally a predetermined distance lengthwise therealong, such as indicated by the broken line 18 in FIG. 1, and then opening each blank's slit into a generally U-shape and sewing the opposing slits of the two blanks together along a U-shaped seam. Conventionally, this operation is performed on an automatic blank-slitting and sewing machine provided with forms for receiving the two hosiery blanks, one such form being schematically depicted in FIG. 2 at 20.

In accordance with the present invention, the marking yarn 12 is formed of a single filament of a water soluble synthetic material, such as polyvinyl alcohol, and is coated with any suitable material which is detectible ultravioletly by a conventional ultraviolet sensor, such as any appropriate known UV-detectible chemical compound. In the preferred embodiment, a substituted coumarin compound dispersed in a liquid oil base is utilized. A coumarin-containing lubricating oil such as Madol brand oil Type 611FF has been found to be suitable for this purpose.

Figure 3:
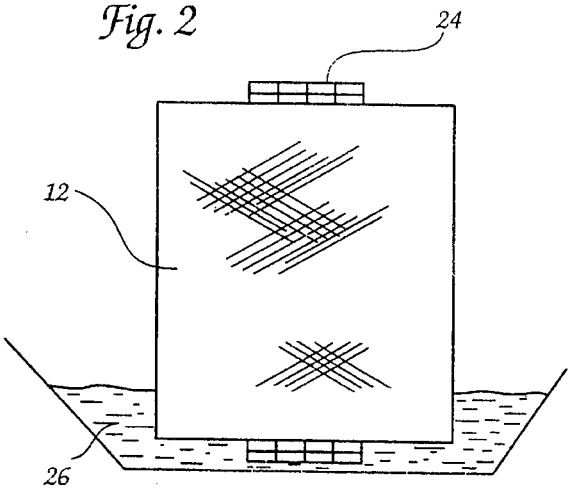
FIG. 3 is a schematic view of the preferred process by which the marking yarn of the present invention is coated with the ultraviolet-detectible material.

The process of coating the water soluble filament with the oil-based chemical composition is depicted in FIG. 3. The marking yarn is conventional wound on a supporting tube 24, preferably fabricated of a plastic material in an open-work configuration, such as a conventional yarn dye tube. The water soluble marking yarn has a substantial wicking capability and, thus, by placement of one end of the supporting tube 24 in a shallow bath 26 of the oil-based coating composition sufficient to submerge a portion of the wound yarn 12 at one end of the package, the yarn will effectively wick the coating composition to impregnate the yarn over the entirety of the package.

The thusly-coated package of the marking yarn 12 is supplied to the knitting machine for use during the formation of the pantyhose blank 10. As previously indicated, the knitting of the blank 10 is initiated by feeding a main body yarn 22 to the knitting needles to initially form the turned welt waistband portion 14 and then to form the main lengthwise extent of the blank 10. During this knitting operation, the marking yarn 12 remains idle and is not supplied to the knitting needles. However, after a sufficient predetermined number of needle cylinder revolutions of the knitting machine to form the upper lengthwise region 28 of the pantyhose blank 10, the patterning mechanism of the knitting machine actuates feeding of the marking yarn 12 simultaneously with the continuing feeding of the main body yarn 22 to the knitting needles, causing the marking and body yarns 12,22 to be knitted by the needles in plated relationship for one or more circumferential courses in the knitted fabric of the hosiery blank 10. Thereafter, the feeding of the marking yarn 12 is terminated, while the main body yarn 22 continues to be fed to the needles of the knitting machine to fabricate the remaining length of the hosiery blank 10, indicated at 30.

Figure 4:
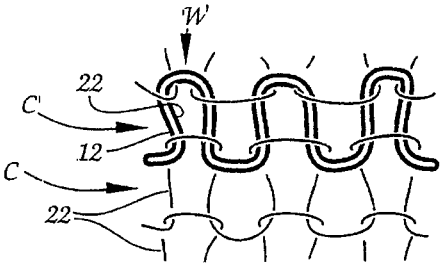
FIG. 4 is a schematic diagram depicting the knitted structure of the hosiery blank of FIG. 1 in the region of the marking yarn indicated at 4 in FIG. 1.

The resultant knitted structure of the hosiery blank 10 in the region indicated at 4 in FIG. 1 is shown schematically in an enlarged form in FIG. 4. As indicated, the main body yarn 22 is formed in needle loops extending circumferentially about the fabric of the hosiery blank 10 in courses C and aligned lengthwise along the fabric of the hosiery blank 10 in perpendicular wales W. During the feeding of the marking yarn 12, the marking yarn 12 and the body yarn 22 are formed identically in plated needle loops overlying one another, as indicated by the course C' in FIG. 4.

As will thus be understood, the fabrication of the hosiery blank 10 in this described manner provides an essentially invisible yet ultravioletly detectible coursewise marking circumferentially about the fabric of the tubular hosiery blank 10 where the marking yarn 12 has been knitted with the main body yarn 22. Thus, when the upper end region 28 of the hosiery blank 10 is telescoped over the form 20 on a pantyhose slitting and sewing machine, the circumferential location of the marking yarn 12 may be ultravioletly detected by substantially any conventional ultraviolet sensor, indicated generally at S in FIG. 2. Advantageously, the marking produced by the yarn 12 is automatically formed in the operation of knitting the hosiery blank 10 and, therefore, does not require the performance of any additional step of marking the hosiery blank preparatory to the pantyhose sewing operation.

Following the pantyhose sewing operation, the resultant pantyhose garment will be subjected to subsequent finishing operations, almost always including a dyeing operation in a water-based dye bath. Accordingly, during such wet processing of the hosiery blank 10, the water-based dye bath will naturally dissolve the water soluble filament base of the marking yarn 12. While the oil-based ultraviolet-detectible coating composition on the marking yarn 12 will not dissolve because it is not water-soluble, the dissolution of the yarn base will nevertheless liberate the coating composition into the dye bath. Because the quantity of the coating composition on the marking yarn 12 is minuscule in relation to the volume of the dye bath, the presence of the liberated coating composition does not affect the ongoing dyeing operation.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A marking yarn detectible by an ultraviolet sensor for selective use in formation of a textile fabric to designate a predetermined location in the textile fabric for subsequent detection in a handling operation performed on the fabric, the yarn comprising an elongate strand-like yarn base at least partially coated with a material which is detectible by an ultraviolet sensor, the yarn base being formed of a material which is soluble in water for dissolution of the yarn from the textile fabric in a wet processing operation performed subsequent to the fabric handling operation for removal of both the yarn base and the coating material from the textile fabric.

2. An ultraviolet-detectible marking yarn according to claim 1, wherein the yarn base is formed of a polyvinyl alcohol material.

3. An ultraviolet-detectible marking yarn according to claim 2, wherein the yarn base is a single continuous filament.

4. An ultraviolet-detectible marking yarn according to claim 2, wherein the ultraviolet-detectible coating material comprises a substituted coumarin compound.

5. And ultraviolet-detectible marking yarn according to claim 4, wherein the ultraviolet-detectible coating material comprises an oil base.

6. An ultraviolet-detectible marking yarn according to claim 1, wherein the ultraviolet-detectible coating material is substantially insoluble in water.

7. An ultraviolet-detectible marking yarn according to claim 1, wherein the yarn base is a single continuous filament.

* * * * *